US007090628B2

(12) United States Patent
Badarneh

(10) Patent No.: US 7,090,628 B2
(45) Date of Patent: Aug. 15, 2006

(54) EXERCISE APPARATUS

(75) Inventor: Ziad Badarneh, Oslo (NO)

(73) Assignee: Flexiped AS, Oslo (NO)

( * ) Notice: Subject to any disclaimer, the term of this patent is extended or adjusted under 35 U.S.C. 154(b) by 0 days.

(21) Appl. No.: 10/451,357

(22) PCT Filed: Dec. 19, 2001

(86) PCT No.: PCT/NO01/00502

§ 371 (c)(1),
(2), (4) Date: Dec. 9, 2003

(87) PCT Pub. No.: WO02/056974

PCT Pub. Date: Jul. 25, 2002

(65) Prior Publication Data

US 2004/0102295 A1 May 27, 2004

(30) Foreign Application Priority Data

Dec. 22, 2000 (NO) ..... 20006619

(51) Int. Cl.
*A63B 26/00* (2006.01)
*A63B 71/00* (2006.01)

(52) U.S. Cl. ..... 482/140; 482/146; 482/34

(58) Field of Classification Search ..... 482/140, 482/146, 147, 79–80, 34, 72, 110; D21/686; 5/101; D6/382
See application file for complete search history.

(56) References Cited

U.S. PATENT DOCUMENTS

| | | | | |
|---|---|---|---|---|
| 2,016,301 | A * | 10/1935 | Lawrence | 169/88 |
| 3,544,103 | A * | 12/1970 | Conable | 482/130 |
| 4,752,067 | A | 6/1988 | Colonello | |
| 4,934,997 | A * | 6/1990 | Skakas | 600/26 |
| 5,279,533 | A | 1/1994 | Yin et al. | |
| 5,676,626 | A * | 10/1997 | Huang | 482/96 |
| 5,702,333 | A | 12/1997 | Waldron et al. | |
| 5,848,663 | A * | 12/1998 | Kuriki | 180/300 |
| 6,149,552 | A * | 11/2000 | Chen | 482/72 |
| 6,676,577 | B1 * | 1/2004 | Stearns | 482/142 |
| 2002/0058573 | A1 * | 5/2002 | Endelman et al. | 482/142 |
| 2003/0114281 | A1 * | 6/2003 | Mackert et al. | 482/123 |
| 2004/0209751 | A1 * | 10/2004 | Thonn | |

FOREIGN PATENT DOCUMENTS

| | | |
|---|---|---|
| EP | 0925809 | 6/1999 |
| FR | 2360323 | 3/1978 |
| JP | 5115581 | 5/1993 |

* cited by examiner

*Primary Examiner*—Lori Amerson
(74) *Attorney, Agent, or Firm*—Rodman & Rodman

(57) ABSTRACT

An exercise apparatus for strengthening a person's muscles when the person is in contact with an apparatus part for support of the person's buttocks and/or back and/or stomach/chest. One apparatus part, for example, a support board for the person's back and/or buttocks is made having positional instability in connection with a support bearing.

15 Claims, 12 Drawing Sheets

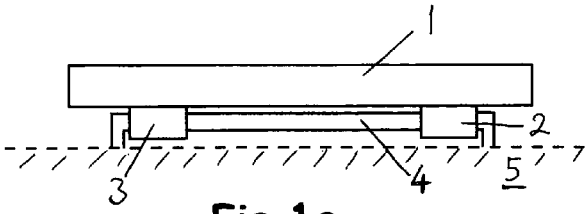
Fig.1a
Fig.1b
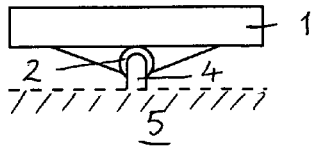
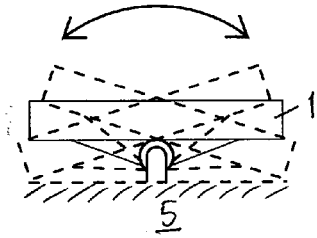
Fig.1c
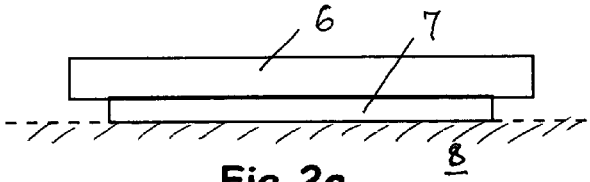
Fig.2a
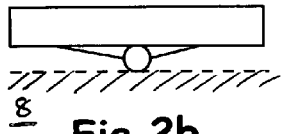
Fig.2b
Fig.3a
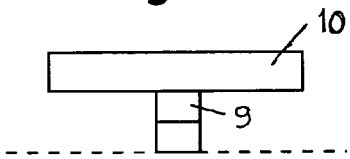
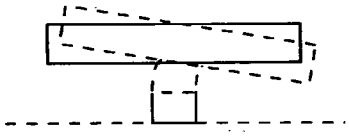
Fig.3b
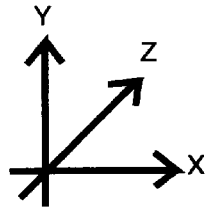
Fig.3c

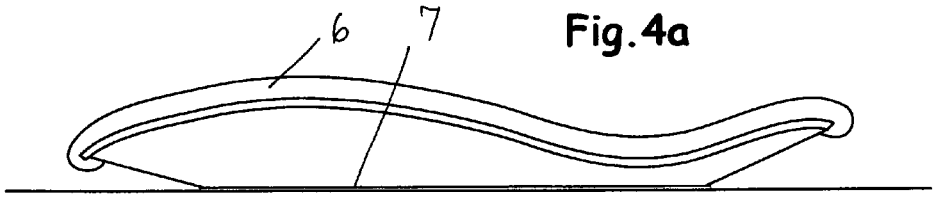
Fig.4a
Fig.4b
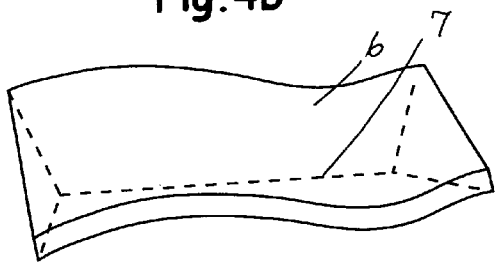
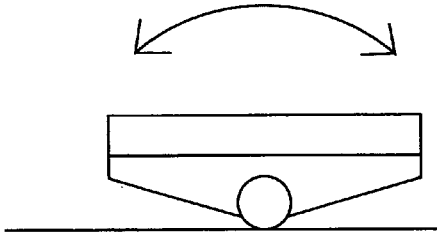
Fig.5
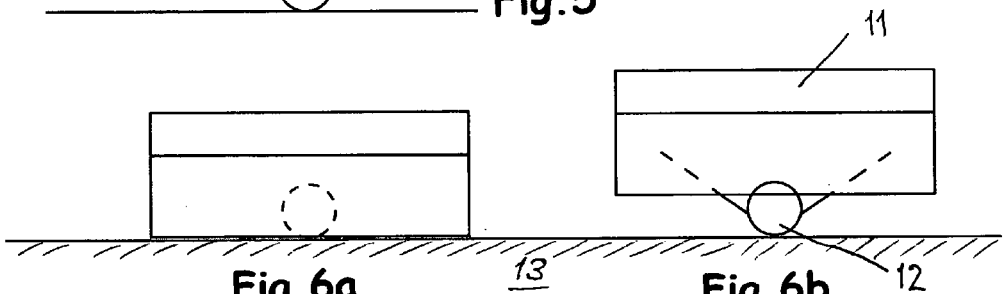
Fig.6a
Fig.6b
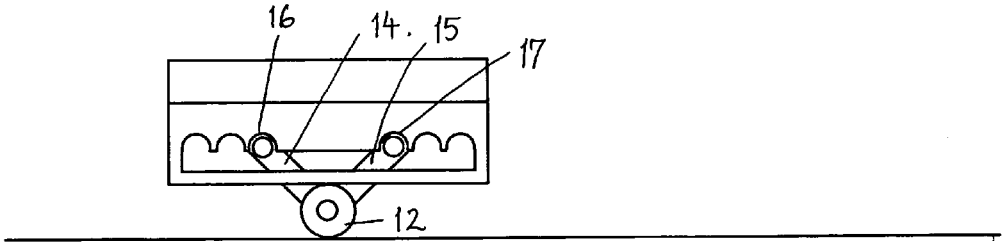
Fig.6c

EXERCISE APPARATUS

The present invention relates to an exercise apparatus for strengthening a person's muscles, and is based in particular on embodiments which are related to the principle of controlled exercising by having to balance or control instability during physical exertion. More specifically, the invention relates to an exercise apparatus as disclosed in attached patent claims 1, 2, 10 and 14.

Today, workout stations and similar fitness or exercise apparatus are well known articles of exercise equipment which allow the whole body to be exercised in a variety of ways. These apparatus work in that they have weights which are lifted up via levers, cables and pulleys or chains running over sprockets during different exercise activities. The major muscle groups are exercised during the different operations. The human body consists of a huge number of muscles and tendons, not all of which necessarily participate in such exercises. This means that the fitness training has most effect, if not all effect, on the main muscle groups.

The exercise apparatus according to the invention is intended primarily to produce an exercise effect on all the muscles and tendons surrounding the muscle group or groups that are principally intended to be exercised. This means to say that during some exercises large parts of the body's muscles will have to be used in order to control the chosen exercise.

In the modern day world, many people have major problems with spinal disorders. A great deal of sedentary work and a generally low level of activity are often contributory causes. At the same time, the passive parts of the back as a locomotive apparatus change. The discs become compressed or flattened and lose their elasticity. The small joints between the individual vertebrae, especially in the lumbar region and the neck, become worn, stiffer and less mobile. Abdominal girth increases with age and the centre of gravity makes its way forward as the abdominal muscles atrophy. This means that the muscles, which earlier were simply there and "adjusted", are put under continual strain which leads to chronic muscular tension and pain. This, in simple terms, is how a non-organic based chronic back patient develops. The busy businessman or woman discovers the need for physical restitution. Thus, the equilibrium of the back must be built up again. However, this requires a strengthening of all the muscle groups which at one time moved the infant from a supine position into a prone position, a sitting position and a kneeling position in order to then move the young child into a standing position and later a walking position. Thus, the key to such a restoration of the back's function lies in using "instability" in a risk-free situation. In this way, the back's most important muscles, namely the abdominal muscles are reached. Starting with the abdominal muscles, the pressure inside the abdominal cavity is increased, causing the anterior stabilisation of the spinal column. This action will produce a reaction from the muscles of the back, both the deep, long extensors of the back and all the superficial ancillary muscles eccentric to the axis of the back. In the rehabilitation of patients with muscle-based, chronic back pain, a "three-dimensional" imbalance which must be compensated solely by the body's own activity is of great interest. Persons suffering from established organic disorders such as osteoarthritis in the vertebral joints, changes in the intervertebral discs and other disorders which result in instability in some of the passive locomotive segments of the spinal column, should, with individual adjustments, also be able to benefit from such rehabilitation.

According to a first embodiment, the exercise apparatus is based primarily on strengthening a person's abdominal muscles when the person is lying on his back and/or carries out from that position an upward movement of his upper body, and when the person's feet are then intended to rest against a firm surface, for example, the floor, and the person's thighs are then intended form an angle with the lower leg. According to the invention, this exercise apparatus is characterised in that the support board on which it is intended that the person's back and/or buttocks should rest is unstably supported by means of at least one support bearing arranged in the longitudinal direction of the support board, whereby the support board is allowed a tilting motion in the transverse direction thereof relative to said firm surface.

In an alternative solution, the exercise apparatus is primarily for strengthening a person's back muscles when the person is lying on his stomach, and optionally tries to raise the upper body, and when the person's knees, lower legs and feet or parts thereof are then intended to rest against a firm surface. This exercise apparatus is characterised, according to the invention, in that a support board on which the person's chest and/or stomach rests is unstably supported, by means of at least one support bearing arranged in the longitudinal direction of the support board, whereby the support board is allowed a tilting motion in the transverse direction thereof relative to said firm surface. According to a further variant, an exercise apparatus is provided for strengthening a person's muscles when the person sits on an apparatus part in the form of a seat, and when the person's feet are intended to rest against a firm surface, e.g., the floor, and the person's thighs are then intended to form an angle with the lower lees where the person's back is intended to have active contact with a back rest and where the person's hands are intended to have active contact with other apparatus parts. This exercise apparatus is characterised, according to the invention, in that either the back rest or the seat is supported in an unstable manner.

According to yet another variant, the exercise apparatus may be designed for strengthening a person's muscles when the person sits on an apparatus part in the form of a seat, where, however, the person's feet are intended be in active contact with a foot rest in the form of a weight-loaded lever arm means, and where the person's hands and/or back is intended to have active contact with other apparatus parts. According to the invention, this exercise apparatus is characterised in that the seat and/or the foot rest is supported in an unstable manner.

Additional embodiments of the respective variants of the exercise apparatus are set forth in the attached patent claims, and in the following description with reference to the attached drawings.

The exercise apparatus described is thus based on instability caused by tilting a part of the apparatus on which the practitioner or user either lies or sits during the performance of various exercises. In the embodiment where the user or the person is to perform so-called "sit-ups" on a bench that tilts transverse to the exercise direction/the spinal column, this will activate all the muscles in the abdominal region, not only the large anterior abdominal muscles, and will also stimulate the body's balance system.

The invention will now be described in more detail with reference to the attached drawings.

FIG. 1*a* shows the principle of a first variant of the exercise apparatus in side view and for mounting in a stand;

FIG. 1*b* is an end view of the exercise apparatus; and FIG. 1*c* shows the exercise apparatus seen from different tilting positions.

FIG. 2*a* is a side view of the exercise apparatus for use directly on a surface; and FIG. 2*b* is an end view of the exercise apparatus.

FIG. 3*a*, FIG. 3*b* and FIG. 3*c* show the principle of the exercise apparatus having movement in all directions.

FIGS. 4*a* and 4*b* show the exercise apparatus in the form of a tilting bench for use directly on a surface.

FIG. 5 shows tilting motion of a fitness apparatus in the form of a tilting bench.

FIGS. 6*a*, 6*b* and 6*c* show the principle for adjusting the degree of tilting of an exercise apparatus.

Figure 7:
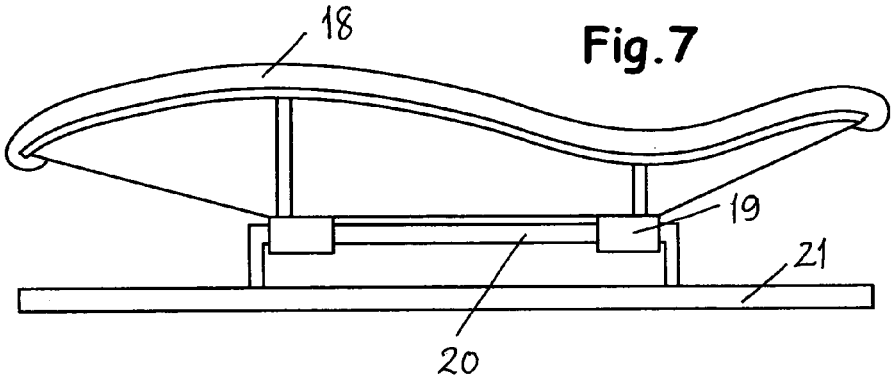
FIG. 7 is a side view of an embodiment of an exercise apparatus in the form of a tilting bench mounted in a stand.
Figure 8:
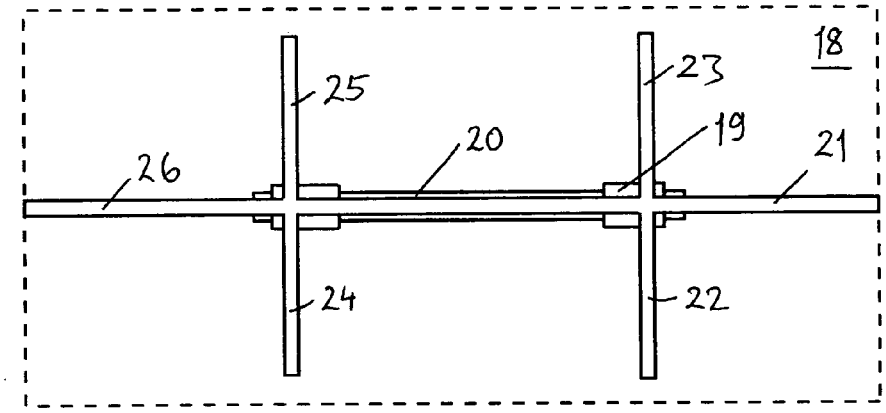
FIG. 8 is a plan view of the exercise apparatus shown in FIG. 7.
Figure 9:
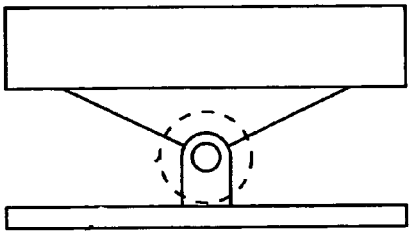
FIG. 9 is a front view of the exercise apparatus shown in FIG. 7.
Figure 10:
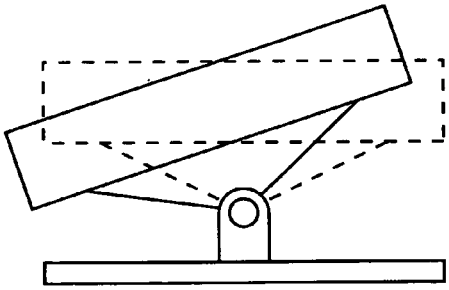
FIG. 10 shows the tilting motion of the exercise apparatus shown in FIG. 7.
Figure 11A:
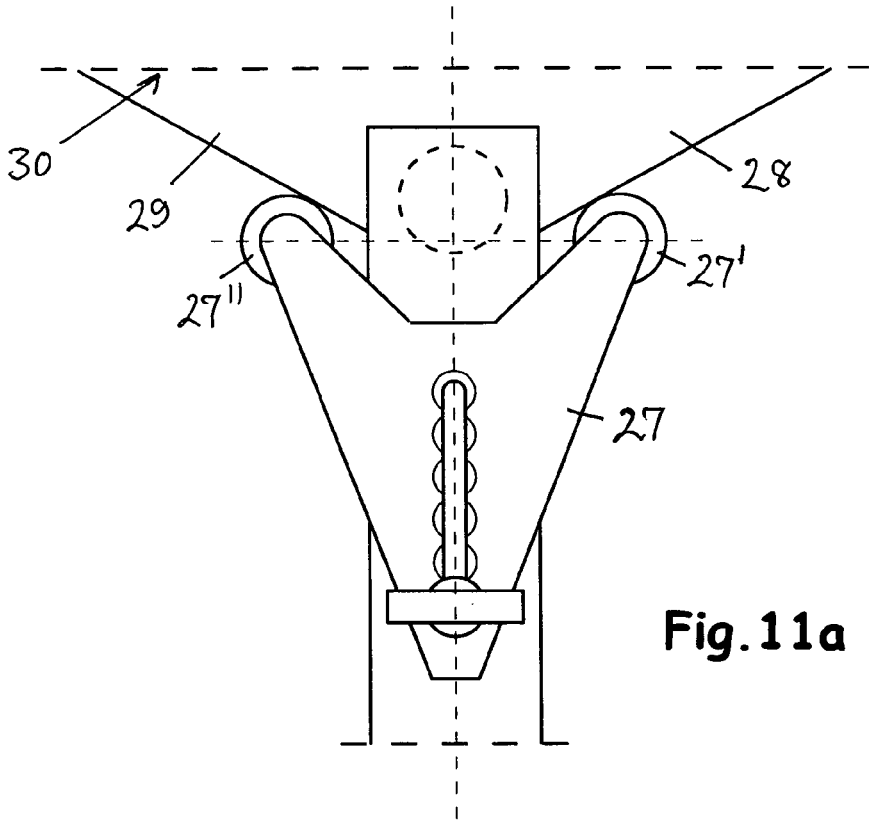

FIG. 11*a* shows a device for limiting the extent of tilt of an exercise apparatus.

Figure 11B:
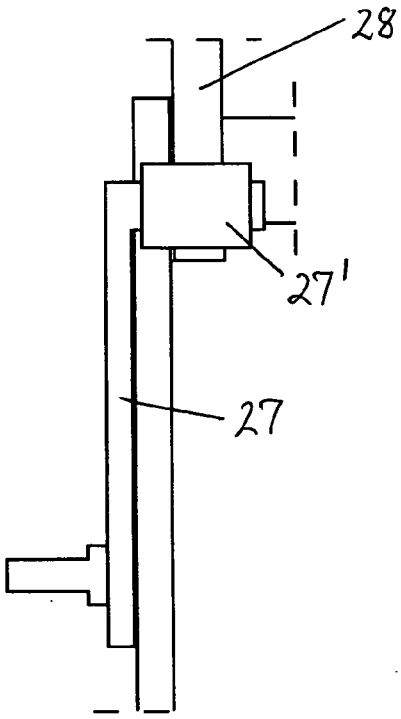

FIG. 11*b* is a side view of the device shown in FIG. 11*a*.

Figure 11C:
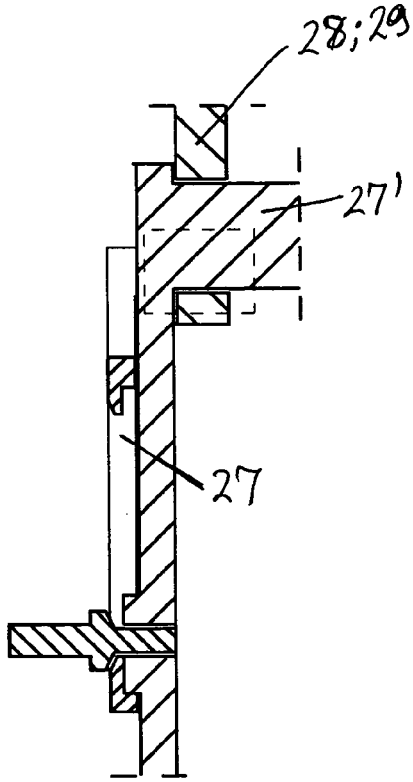

FIG. 11*c* is a vertical, central cross-section through the device shown in FIG. 11*a*.

Figure 12:
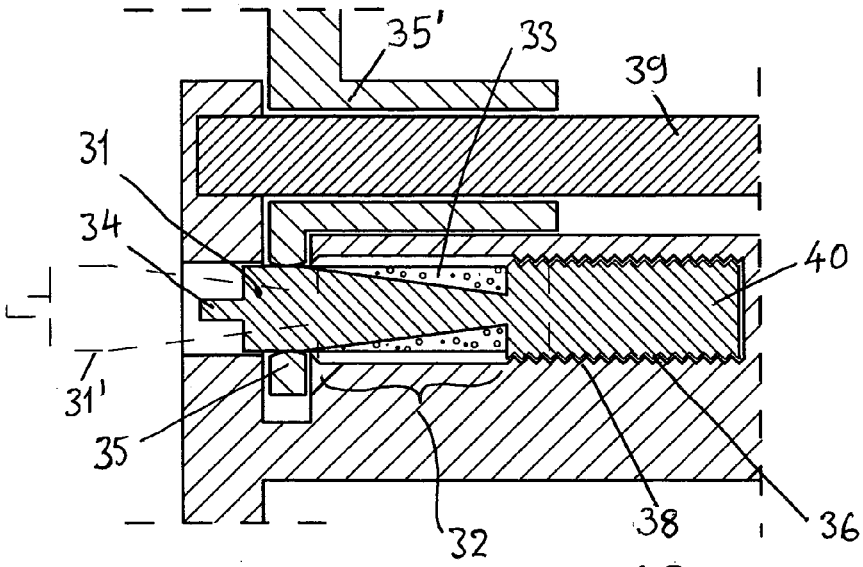

FIG. 12 shows another device for limiting the extent of tilt.

Figure 13A:
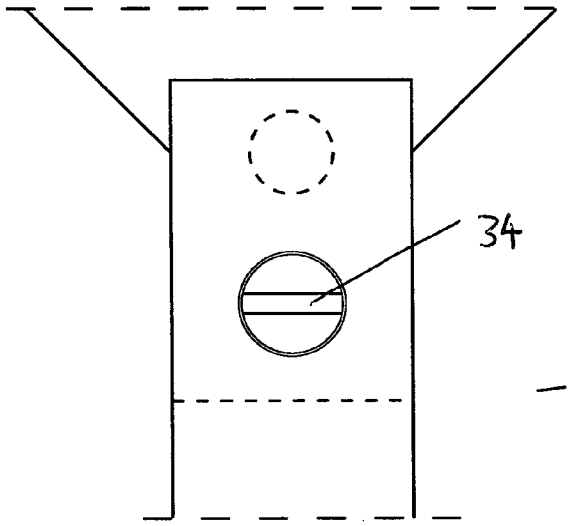
Figure 13B:
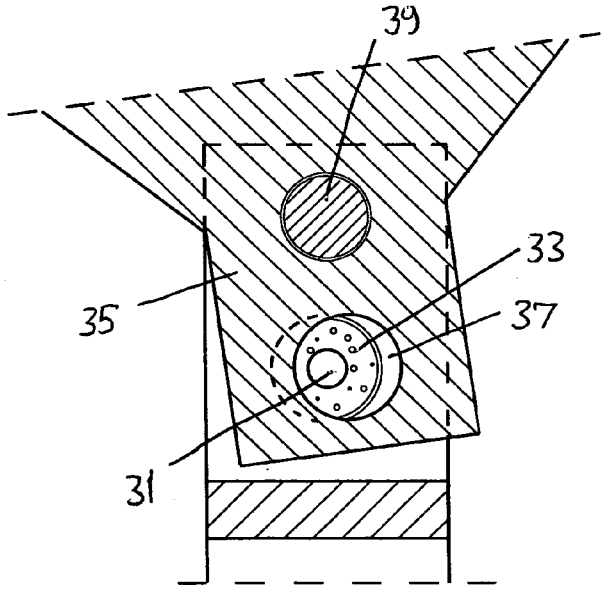

FIG. 13*a* is an end view of the device shown in FIG. 12; and FIG. 13*b* is a vertical cross-section through the device shown in FIG. 12.

Figure 14:
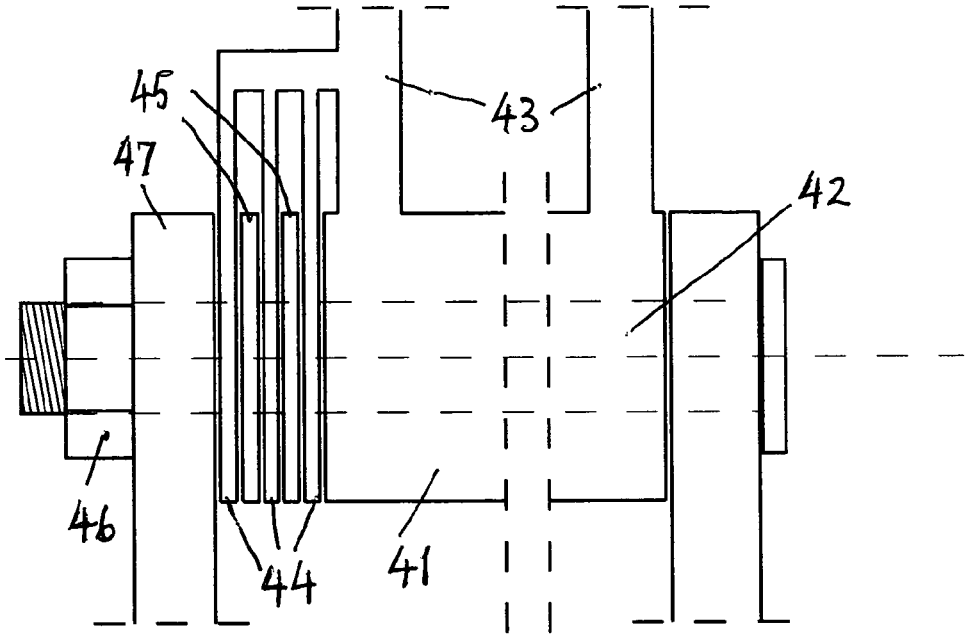

FIG. 14 shows another device for limiting the extent of tilt.

Figure 15:
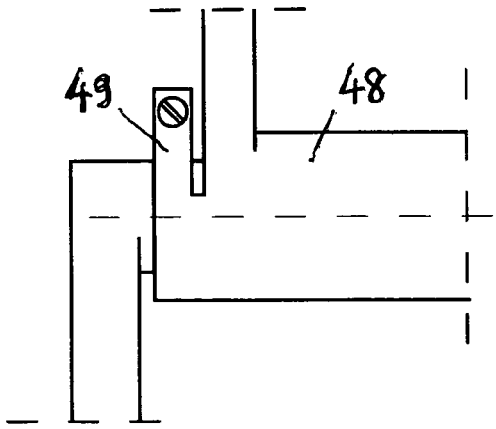
Figure 16:
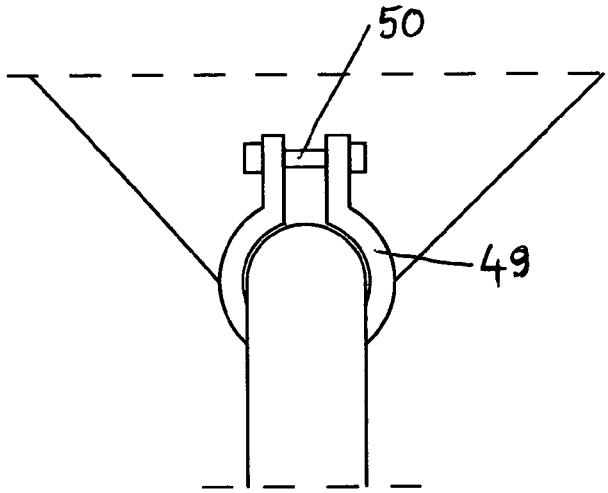

FIG. 15 is a side view of another device for limiting the extent of tilt; and FIG. 16 is an end view of the device in FIG. 15.

Figure 17:
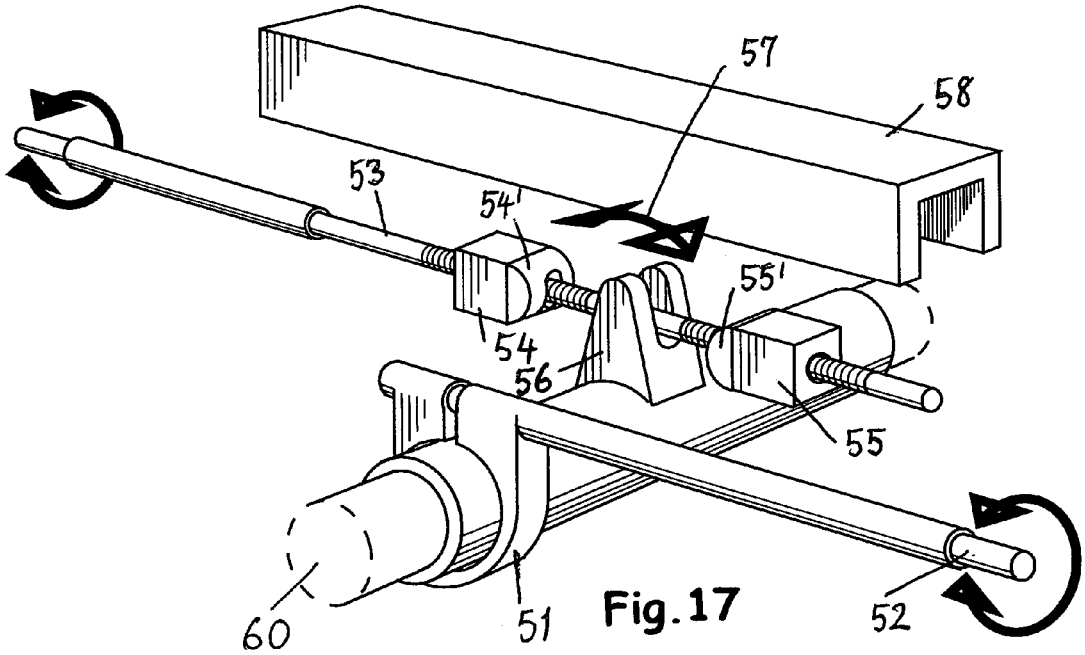

FIG. 17 shows a complete embodiment for limiting the extent of tilt and braking the motion of the tilting device incorporated in an exercise apparatus.

Figure 18:
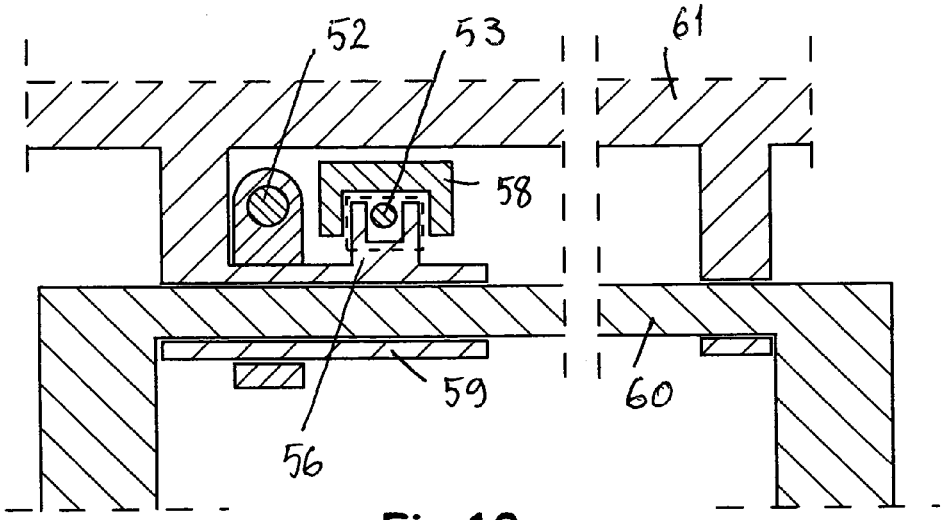

FIG. 18 is a vertical cross-section through the construction shown in FIG. 17.

Figure 19:
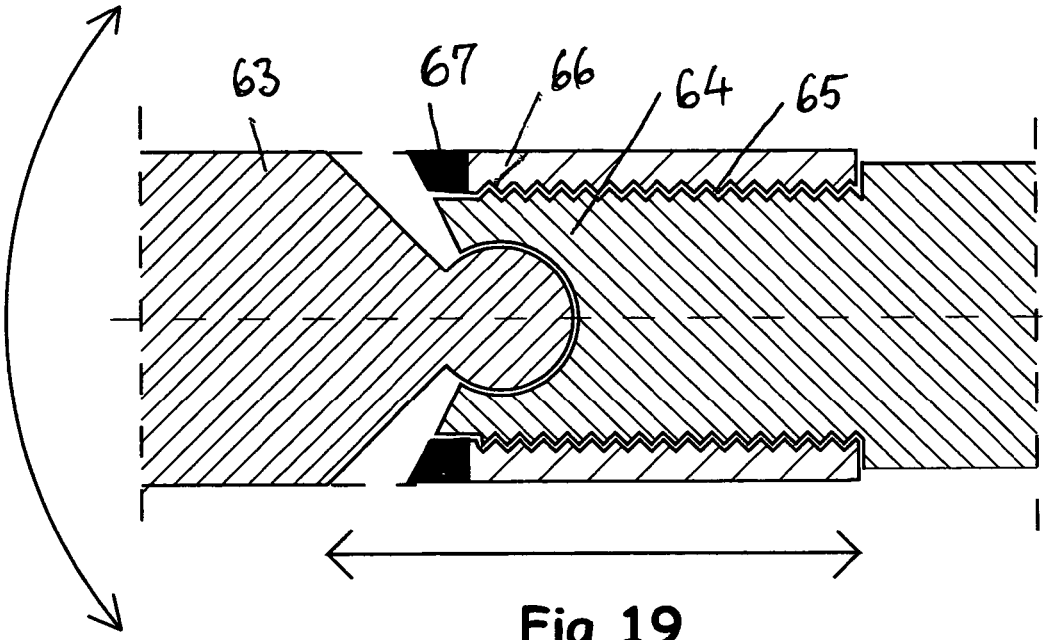

FIG. 19 shows an unstable joint which may be an integral part of the exercise apparatus for movement in all directions, and a means for limiting the freedom of movement.

Figure 20:
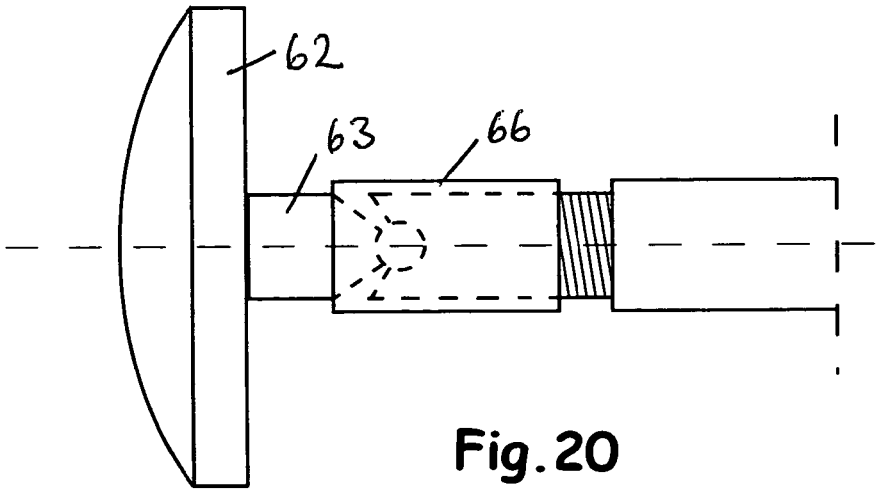

FIG. 20 is a schematic illustration of a handle or hand grip equipped with an unstable joint according to the embodiment shown in FIG. 19.

Figure 21:
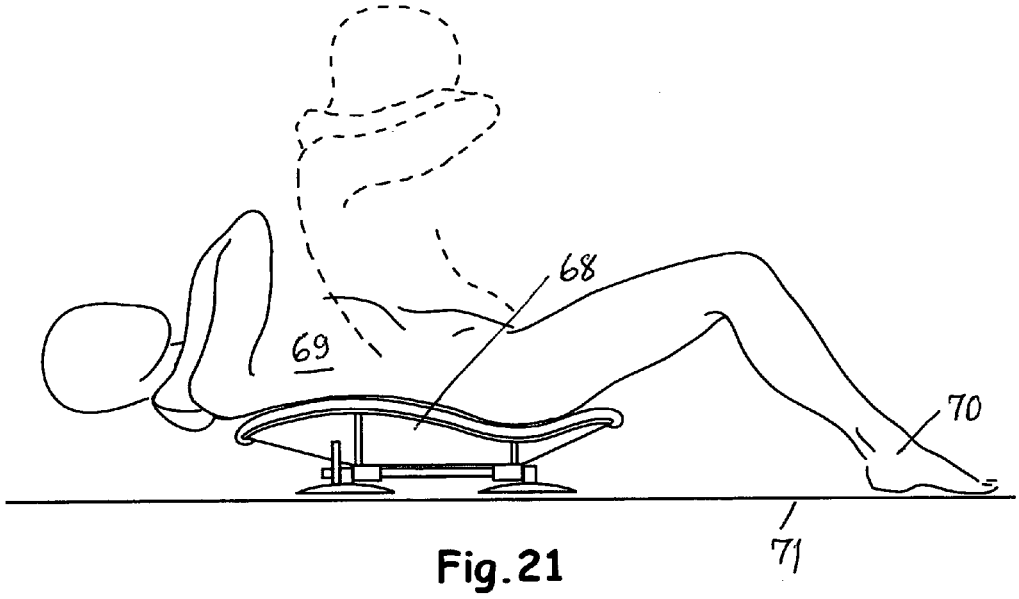

FIG. 21 shows the use of an exercise apparatus in the form of a tilting bench for performing sit-ups.

Figure 22:
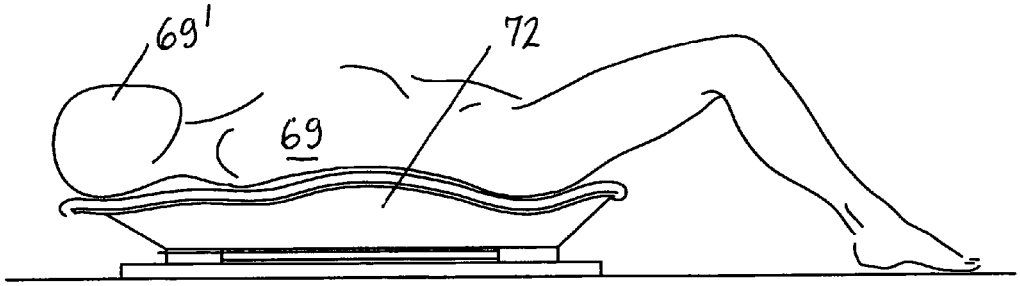

FIG. 22 shows an alternative embodiment of the exercise apparatus in the form of a tilting bench with support for the head.

Figure 23:
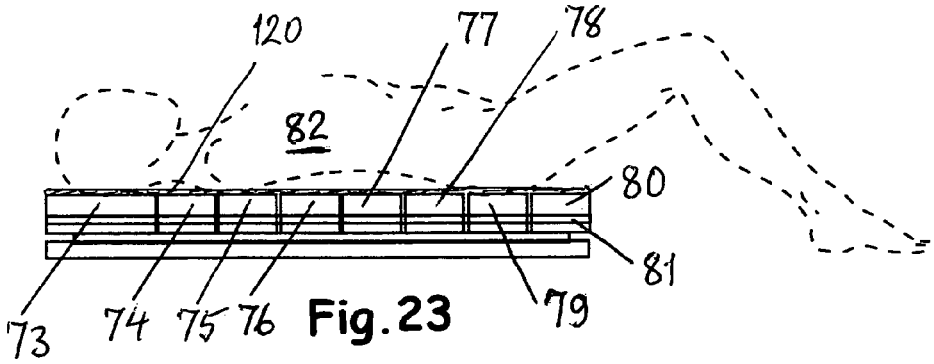
Figure 24:
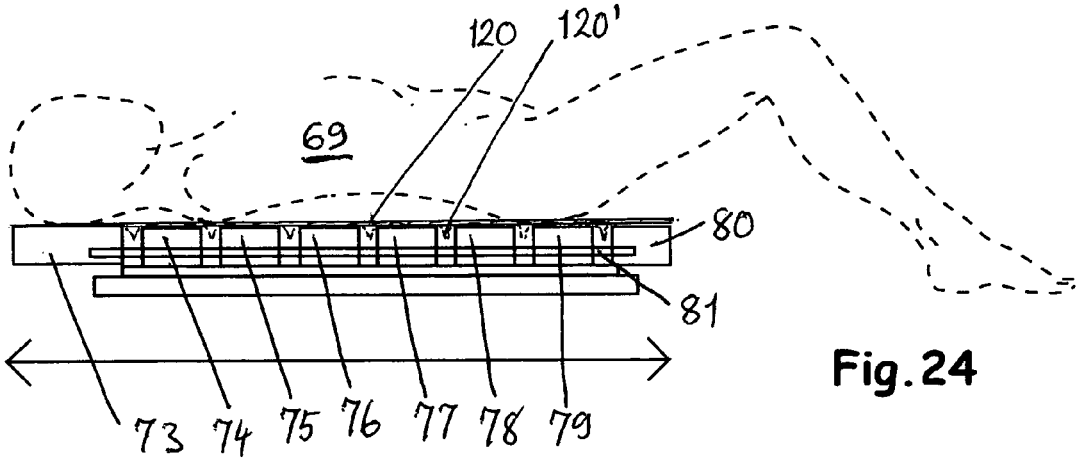

FIG. 23 shows the exercise apparatus in the form of a tilting bench with support for the head; and FIG. 24 shows the same, but includes an illustration of the means of extending the tilting bench in the longitudinal direction in order to adapt it to the user's body length.

Figure 25:
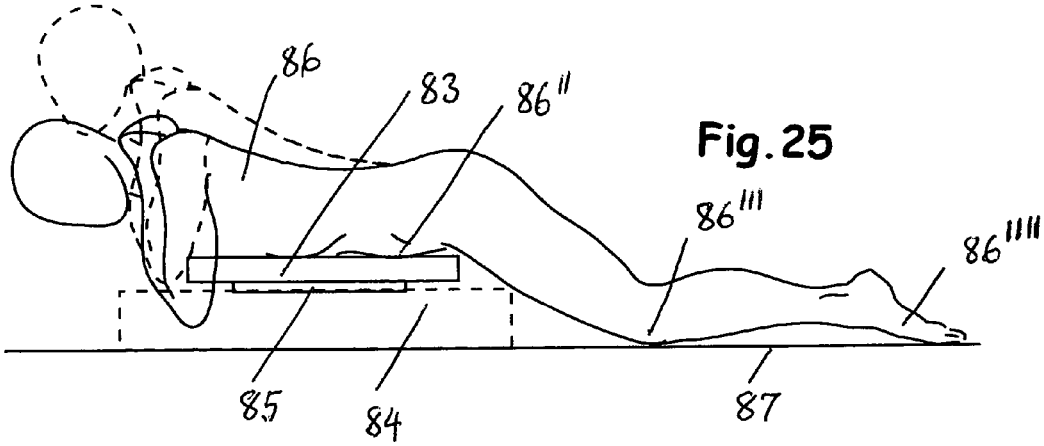

FIG. 25 shows an exercise apparatus in the form of a tilting bench for exercising back muscles under instability.

Figure 26:
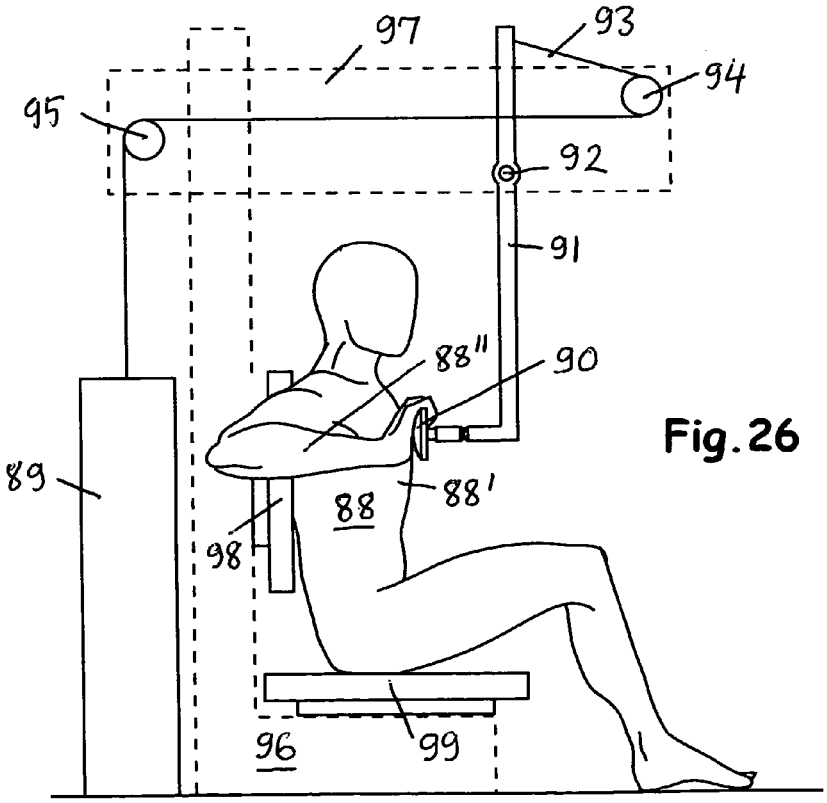

FIG. 26 shows the principle of an exercise apparatus having an adjustable, unstable bench or seat, back support and handles, and primarily for exercising the upper body and arms.

Figure 27:
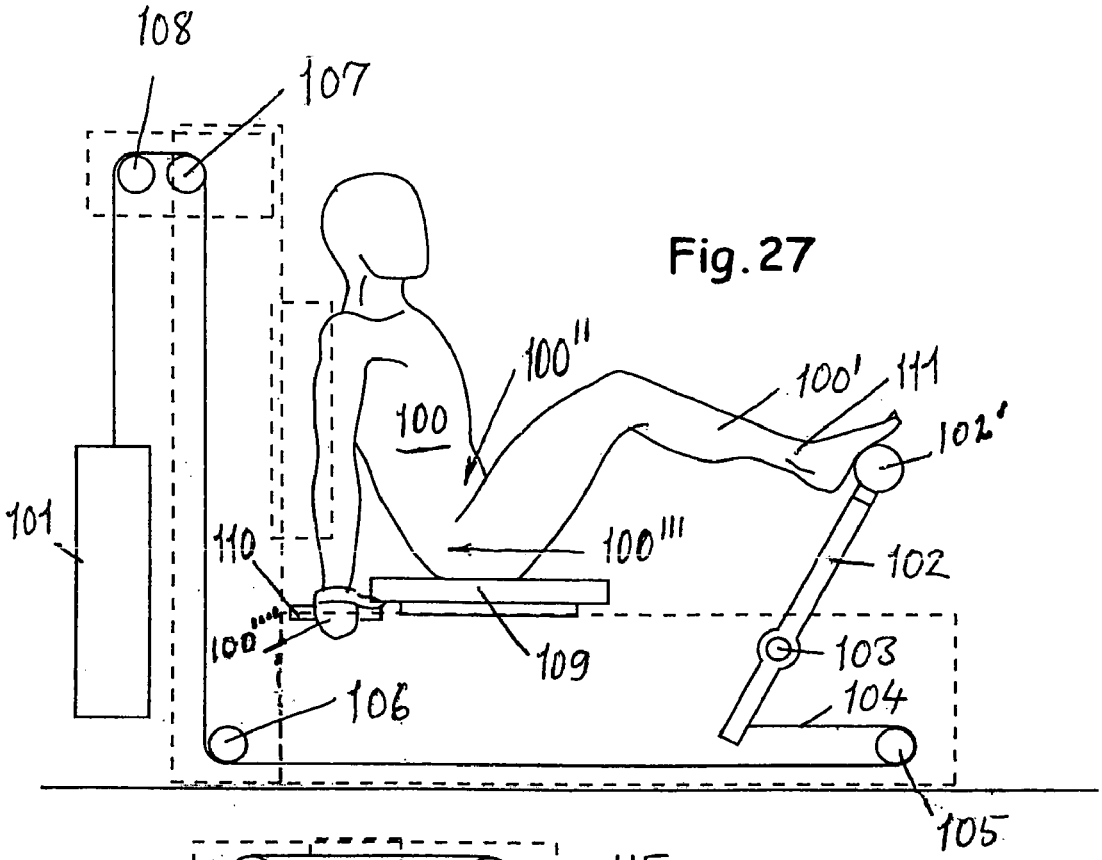

FIG. 27 shows the principle of an exercise apparatus with adjustable, unstable bench or seat, primarily for strengthening the leg muscles.

Figure 28:
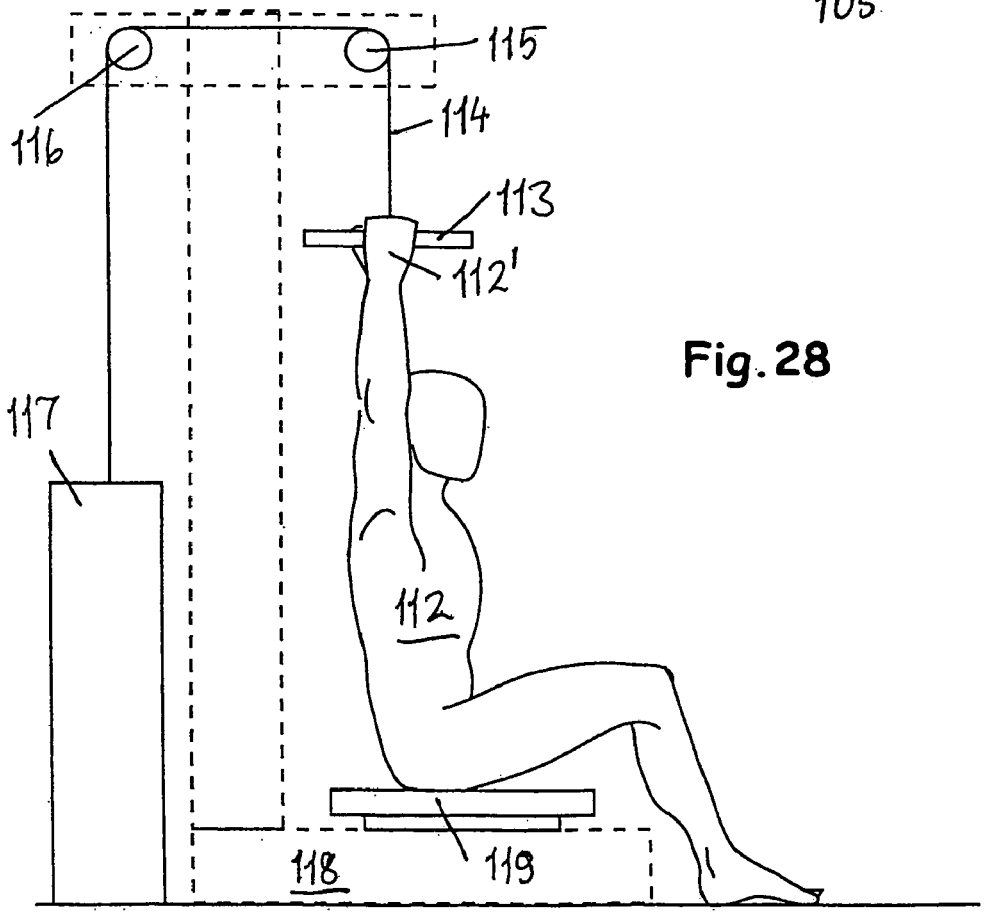

FIG. 28 shows the principle of an exercise apparatus which has an adjustable, unstable bench or seat.

The exercise apparatus is based on the concept that parts thereof can be adjusted so as to be more or less unsteady and unstable. The exercise apparatus is made to produce an exercise effect on all muscles and tendons surrounding the muscle group or groups that are primarily intended to be exercised. This means that during some exercises large parts of the body's muscles will have to be used in order to control the chosen exercise.

The exercise apparatus itself can be constructed in a way that is partly known. There are innumerable methods of construction and different designs of exercise apparatus for different training exercises. The exercise apparatus illustrated and described in this application is based on instability and a tilting principle for a seat, bench, handles, back rest, foot rests and other support structures (not shown). Thus, the present invention is directed towards the design of these applications with a view to functionality, and also applications which are not included in the prior art. These applications are normally constructed so that they can be removed from the exercise apparatus and used alone in different situations, independent of the whole workout station or exercise apparatus.

The exercise apparatus shown in FIG. 1 has a support board on which the person's back and/or buttocks can rest, but which is unstably supported via support bearings 2, 3 and where the support bearing cooperates with, for example, a clamp structure 4 which is anchored in a surface 5. FIG. 1*b* is an end view of the apparatus in FIG. 1*a* and FIG. 1*c* shows the apparatus in different tilting positions.

In FIG. 2*a* the exercise apparatus is equipped with a support board 6 for the person who is to use the apparatus and with a support bearing 7 which rests directly on a surface 8, for example, a floor.

FIG. 3*a*, FIG. 3*b* and FIG. 3*c* show how an exercise apparatus could be made tiltable in the x, y, z direction by means of a flexible support bearing 9 which supports a support board 10.

FIG. 4*a* and FIG. 4*b* are respectively a side view and a perspective view (schematic) of an exercise apparatus for direct support on a floor. FIG. 5 shows the lateral tilting possibilities in this case.

FIGS. 6*a*, 6*b* and 6*c* show an exercise apparatus equipped with a support board for the user of the apparatus and where the support board is indicated by the reference numeral 11 and where there is a bearing support for the exercise apparatus, where said support bearing, indicated by the reference numeral 12, rests on a surface 13. FIG. 6*c* shows in more detail how the support bearing can be equipped with arms 14, 15 whose upper ends are movable to points of support, such as points of support 16, 17. In this way, it will be possible, even with the support bearing, to pack the exercise apparatus flat, as shown in FIG. 6*a*. Although the support bearing in this case is shown to be stepwise adjustable, it is of course possible to make it steplessly adjustable.

FIGS. 7–10 shows a solution where the exercise apparatus is in the form of a tilting bench having a support board 18 for the user. In this case too, there is a support bearing 19 which forms a pivotal connection with an anchoring clamp 20 and where the clamp 20 is fastened to a base part 21 of the exercise apparatus. The support board 18 may optionally be directly supported by arms 21, 22, 23, 24, 25 and 26.

FIGS. 11–20 shows different solutions for limiting the extent of tilt of parts of the exercise apparatus, and the control of such motion.

If exercising with instability is to have the desired effect, it is not important that the extent of tilt is particularly great. Tilts of small extent with instability are usually sufficient. If the exercise apparatus permits tilts of excessively large extent, this may in some cases result in the user or practitioner inadvertently injuring himself.

There are countless solutions for controlling the extent of the motion, and adjustment for controlling the motion itself. The embodiments based on instability joints build per se on prior art, but coupled with the main inventive idea, the prior art will provide the basis for the characteristic features of the apparatus.

Thus, in said FIGS. 11–20 it is indicated how tilting/instability can be adjusted. In fact, this will inevitably mean that the extent of tilt can be set.

FIG. 11*a* shows a bracket 27 which supports arms 28, 29 and which in turn support the support board, indicated in this figure by the reference numeral 30. By pushing the bracket up or down it is possible to adjust the degree of stability. The more the bracket 27 is moved downwards, the more unstable the support board 30 will be, as the clearance between the arms 28, 29 becomes greater relative to collars 27', 27" on the bracket 27.

FIGS. 12 and 13 show an alternative tilt limiter and damping device. This tilting device consists of a bolt 31 which at an area 32 has different density along its axis. The basic structure of the bolt 31 may be of metal or high-density plastic and have a tapering cross-sectional shape as shown. The space at the point where the shape ceases to be cylindrical can be filled with a softer material, as indicated by means of the reference numeral 33. Thus, ideally the bolt structure is still one having a uniform cross-section. The intended tilting motion can thus be adjusted by turning the bolt 31 via a turning handle 34, so that the engaging part 35 of the device ends up at the chosen point of the bolt structure 31, 33. The material 33 may, for instance, consist of rubber. And the engaging part 35 can be made in the form of a ring around a hole 37 through which a small portion of the bolt 31, 33 extends. Since at its end portion 40 the bolt 31 is made having threads 36 which engage with a threaded portion 38 of the device, it is possible to screw the bolt in both directions. When the bolt 31 is turned as far as indicated by the reference numeral 31', the ring or the engaging part of the device as indicated by the reference numeral 35 engages with the soft part 33 surrounding a part of the bolt 31, thereby causing the tilting device on the exercise apparatus to provide an unstable tilting state. Thus, the degree of softness related to the material 33 will have a variable value along the bolt 31, so that the degree of instability can be set steplessly at a desired value. The elastically yielding material 33, such as rubber, will also have a damping effect on the tilting motion. This effect would not have been obtained if the rubber 33 had been removed from the bolt 31, as in that case the motion would have been completely undampened.

In FIGS. 12 and 13 the support bearing is indicated by means of the reference numeral 35' and the tilt shaft about which the support bearing is arranged is indicated by the reference numeral 39.

FIGS. 14, 15 and 16 show typical braking devices for use with the exercise apparatus according to the invention and in connection with the support bearing of the support board. In FIG. 14 the support bearing is indicated by means of the reference numeral 41 and is pivotal about a shaft 42. In connection with arms 43, which support the tilting support board (not shown), there is provided a plurality of mutually parallel brake plates 44 with intermediate discs 45. Tightening a nut 46 will cause posts 47 to come into contact with the plates 44, thereby increasing friction between the plates 44 and the disc 45, so that friction braking takes place. A similar, but simpler construction is shown in FIGS. 15 and 16 where a support bearing 48 is equipped with a clamping means 49 which can be adjusted by means of a bolt connection 50.

The solution shown in FIGS. 17 and 18 will now be described in more detail. Here, there is a friction device 51 that is adjustable by means of an adjusting screw 52 and has the same effect as that shown and described in connection with FIGS. 15 and 16. To adjust the extent of tilt, an adjusting means 53 can be provided which has end stops 54, 55, optionally equipped with cushioning material 54', 55' and where, when the apparatus tilts as indicated by the arrow 57, a fork 56 is brought to rest against one or other of the stops 54 or 55. A guide rail 58 for the end stops 54, 55 can be arranged over the tilt limiting device 53. The support bearing is indicated by the reference numeral 59 and is disposed about a tilt shaft 60 which may be mounted in an expedient manner on a base or platform. The fork 56 moves concurrently with the support bearing 59. The support board for the person is not shown, but will be supported by the top portion 61 of the support bearing.

FIG. 19 shows a section of the construction with an adjustable instability joint which is primarily intended for use as a hand grip and/or foot rest. A braking device is indicated generally by the reference numeral 19'.

FIG. 20 shows a hand grip 62 with instability joint 63 which is supported in a holder 64 and where the holder has a threaded portion 65 which cooperates with the threaded portion on an adjustment sleeve 66 which at its free end closest to the instability joint 63 is equipped with elastically yielding material 67. Although it is not shown directly in the drawings, it will of course also be possible to provide other braking devices to brake tilting motion, as for instance, by mounting adjustable oil or air brakes between the tilting part (the support surface) and the frame to which the support bearing is connected.

FIG. 21 shows an exercise apparatus in the form of a tilting bench 68 on which a person 69 can lie. The degree of instability can be adjusted by spacing apart the feet 70 on a surface 71, and/or by mounting a tilt control means as shown and described above. FIG. 22 shows per se the same as FIG. 21, except that the tilting bench in this figure is indicated by the reference numeral 72 and has been extended to include a support of the person's or user's 69 head 69'.

FIGS. 23 and 24 show an exercise apparatus where the support board consists of slats 73–80 which are slidable relative to a support body 81, for example, two or more slide bars. A person 82, for example, a youth or a child, lies on the support board consisting of the slats 73–80. In FIG. 24 it will be seen that the slats 73–80 have been displaced relative to one another so that there is a gap between adjacent slats 73–80, thus enabling the support board provided by the slats to provide effective support for an adult person 69. A mat 120 is expediently provided on top of the slats, and when the slats are in a position as shown in FIG. 23 the mat parts which in FIG. 24 extend across the gaps between the slats are located down between the slats, as shown in broken lines 120' in FIG. 24.

FIG. 25 shows the use of an exercise apparatus in the form of a tilting bench 83 which rests tiltably against a support 84 via a support bearing 85, thereby allowing the person 86 to perform back exercises whilst his abdomen 86" rests against the tilting bench 83. At the same time, it will be seen that the person also has knee 86''' and foot 86'''' resting on a surface 87.

FIG. 26 shows an exercise apparatus for an exercise where the user's 88 body upper body 88' and arms 88" are exercised. The apparatus has weights 89 which are lifted by the user 88 pushing the handles 90 away from his body. The weight 89 is lifted via a lever 91 which is supported at a point of support 92 and via cable 93 and pulleys 94, 95. The user sits on a bench 96 which at the top merges into a support structure 97 which supports the point of support 92 and the pulleys 94, 95. The back rest on the bench 96 is indicated by the reference numeral 98 and the seat board is indicated by the reference numeral 99. Both the back rest and the seat board can be adjusted from being stable to being unstable. The handles 90 are also freely adjustable so as to be stable or unstable. It is important to note that all the parts 90, 98 and 99 which can also be rendered unstable as desired by the user 88 during a normal training session can be made immobile or, for example, at least one of the parts 90, 98 and 99 can be made unstable. This instability ensures that the user 88 inevitably tautens the right muscles in the pushing movement which must be made to lift the weight 89. For instance, the back rest 98 and the seat board 99 can be locked, and when the users performs the exercise shown in FIG. 26 he will have to keep his wrists stable. This will activate all the surrounding muscles. A further alternative is to lock the back rest 98 and the handles 90. In this solution, the user will have to keep his upper body straight by stabilising the tilting of the seat board 99.

If the seat board 99 and the handles 90 are locked, the user will have to compensate for the twisting of the upper body as the back rest in this case will tilt or turn.

FIG. 27 shows an exercise where a person 100 is to use his legs 100' to lift a weight 101 via a system consisting of a lever arm 102 which rotates about a center of rotation 103, and where a wire 104 runs from the lever arm 102 via pulleys 105, 106, and 107 and 108. This exercise will normally effect exercising of the major muscle groups in the legs. For this exercise, the exercise apparatus is constructed so that the seat board 109 is tiltable and adjustable from an unstable tilting position to a fixed stationary position, and the foot rest 102' may optionally be adjustably stable or unstable. It will probably be most convenient to have the joint at the seat board or the foot rests locked during use. The foot rest 102' may optionally be made of a type as shown in FIG. 19 or 20 or as a tiltable pedal.

If the seat board 109 is allowed to be tiltable, the person 100 exercising must keep his balance during the exercise. The person supports his body by letting his hands 100'" grasp the hand grip 110. When the seat board 109 is thus tiltable, the person 100 working out must keep his balance during the exercise. In this case, an active use of the muscle groups around the abdominal region 100" is achieved because the user's hip joint 100'" must compensate for tilting motion during this exercise. By, for instance, locking the seat board 109, but making the foot rest 102' movable or unsteady during this exercise, the user's ankle joint 111 will also endeavor to remain stable so as to enable the user to apply pressure against the effect of the weight 101. Here, all the muscles around the ankle joint itself will have to be activated.

Exercising in this way will result in a greater effect on the muscles that the user intended to exercise, and also in the exercising of many other groups as well. This means that to be able to obtain the same effect as with a stable exercise system, the exercise session need not last as long. It has been found that fewer repetitions of the training exercise are required in order to obtain the same effect.

FIG. 28 shows an exercise apparatus where the practitioner or user 112 must pull a bar 113 down by using his hands 112' via a wire 114 which runs over pulleys 115–116 and ends in a weight 117. The purpose of this exercise is that the practitioner or user 112 must pull the bar 113 down behind his neck or in front of his head and at the same time sit unstably on the seat board 119 of the bench 118. When the bar 113 is pulled downwards, the weight 117 will be lifted. The purpose of this exercise is to train the whole of the upper body, and also that the instability during this exercise must be adjusted continuously. It has been found to produce good effect on the muscles of the back, stomach and in the diaphragmatic region etc.

To achieve a more stable exercising, the extent of tilt of the different parts can be adjusted and optionally locked in a stable position, but in this case the result will be an exercise apparatus that is known per se. The essential novelty of the exercise apparatus shown in FIGS. 26–28 is that one of the apparatus parts is made having positional instability.

As indicated above, the exercise concept permits a combination of exercising with fixed and partly unsteady or unstable parts and with fixed parts in any combination desirable in order to obtain the right exercise effect.

One effect of exercising with instability (strength), besides physically strengthening muscles and tendons, is the promotion of balance. The invention has the effect of training the balance system of the body. This refers to the interplay between the brain and the muscles. Such training will give a highly positive effect on balance, i.e., instinctive reaction.

The invention claimed is:

1. An exercise apparatus comprising, an oblong support board having an upper portion and a lower portion and at least one unconfined open free longitudinal end portion to permit the upper body portion of a person to be supported on the upper portion with the person's legs extending beyond the unconfined open free longitudinal end portion, tilting means being joined to the lower portion of said support board for supporting the support board in an unrestrained, unstable support position wherein the support board is freely tiltable about a longitudinal axis, said tilting means having at least one support bearing below the upper portion of the support board and said longitudinal tilt axis extends through said support bearing, said support board being pivotable in opposite transverse directions about the longitudinal tilt axis, and tilt limiting means being provided at the lower portion of said support board for limiting the tilting excursion of the support board in said opposite transverse directions, whereby a person lying face up or face down on the upper portion of the support board and exercising thereon with feet extended beyond said open free longitudinal end portion to rest against a firm surface must also use muscles to prevent the support board from tilting, thereby strengthening the abdominal or back muscles depending upon the face up or face down position of the person.

2. An exercise apparatus comprising, a support board for supporting all of or a portion of a person's body weight, said support board having an upper portion and a lower portion and at least one unconfined open free end portion to permit a person's legs to extend therefrom when a person is lying or sitting on the upper portion of the support board, tilting means being joined to the lower portion of said support board for supporting the support board in an unrestrained, unstable support position wherein the support board is freely tiltable about a pivot axis, said tilting means having at least one support bearing below the upper portion of the support board and said pivot axis extends through said support bearing, said support board being pivotable in opposite directions about the pivot axis, and tilt limiting means being provided at the lower portion of said support board for limiting the tilting excursion of the support board in said opposite directions, whereby a person positioned on the upper portion of the support board and exercising thereon must also use muscles to prevent the support board from tilting, thereby strengthening the muscles that are used to stabilize the support board.

3. An exercise apparatus as disclosed in claim 1, wherein the support bearing has a device for inertial adjustment of the tilting of the support board.

4. An exercise apparatus as disclosed in claim 1, wherein said tilt limiter is adjustable in steps or step-free.

5. An exercise apparatus as disclosed in claim 1, wherein the support bearing is terminated at its bottom in a foot or base which rests against the firm surface.

6. An exercise apparatus as disclosed in claim 1, wherein the support bearing is a part of a stand which can be wholly or partly folded away in the lower portion of the support board.

7. An exercise apparatus as disclosed in claim 1, wherein the upper portion of the support board is ergonomically shaped to the user's back, or is of a material or design that adapts itself to the user's back.

8. An exercise apparatus as disclosed in claim 1, wherein the support board has a physical extension being adjustable to fit a physical dimension of the user.

9. An exercise apparatus as disclosed in claim 1, wherein the physical length of the support board is designed to support the user's body from the head region to the hip region.

10. An exercise apparatus as disclosed in claim 2, wherein the support bearing has a device for inertial adjustment of the tilting of the support board.

11. An exercise apparatus as disclosed in claim 2, wherein said tilt limiter is adjustable in steps or step-free.

12. An exercise apparatus as disclosed in claim 2, wherein the support bearing is terminated at its bottom in a foot or base which rests against the firm surface.

13. An exercise apparatus as disclosed in claim 2, wherein the support bearing is a part of a stand which can be wholly or partly folded away in the lower portion of the support board.

14. An exercise apparatus as disclosed in claim 2, wherein the support board has a physical extension being adjustable to fit a physical dimension of the user.

15. An exercise apparatus as disclosed in claim 2, wherein the physical length of the support board is designed to support the user's body from the head region to the hip region.

* * * * *